United States Patent [19]

Britschgi et al.

[11] 4,010,995

[45] Mar. 8, 1977

[54] ELECTRICAL OUTLET GUARD

[76] Inventors: Robert H. Britschgi, 4515 Sierra View Way, Fair Oaks, Calif. 95826; Jerry C. Frinzel, 5324 Tiburon Way, Sacramento, Calif. 95841

[22] Filed: Nov. 14, 1975

[21] Appl. No.: 631,888

[52] U.S. Cl. ..... 339/45 R; 339/110 P

[51] Int. Cl.[2] ..... H01R 13/62

[58] Field of Search ..... 339/36, 45, 110 P

[56] References Cited

UNITED STATES PATENTS

| | | | |
|---|---|---|---|
| 1,714,763 | 5/1929 | Boyson | 339/110 P |
| 1,857,377 | 5/1932 | Hubbell, Jr. | 339/123 |
| 2,051,425 | 8/1936 | Schlums | 339/45 R |
| 2,134,345 | 10/1938 | Sheeran | 339/45 R |
| 2,986,719 | 5/1961 | Adams | 339/45 R |

*Primary Examiner*—Roy Lake
*Assistant Examiner*—Neil Abrams
*Attorney, Agent, or Firm*—Lothrop & West

[57] ABSTRACT

A star-shaped array of limbs projects radially outwardly from a central circular cylindrical hub in clamping engagement with an electrical plug. With the plug prongs inserted in the respective slots of an electrical wall outlet, the outer extremities of the radial limbs engage the surface of the underlying wall in the vicinity of the cover plate of the electrical outlet.

The limbs are of sufficient length so that even though the electrical conductor connected to the plug is pulled laterally, the plug prongs are compelled to withdraw substantially axially from the outlet. The outer extremity of one or more of the limbs serves as a fulcrum about which the outlet guard tilts as plug withdrawal occurs, the radial distance from the plug axis to the fulcrum being such that only a minimal amount of lateral component is exerted on the plug prongs and outlet as the plug is withdrawn. Damage to plug and outlet is thereby eliminated despite misuse and negligent handling of the plug and conductor connected to the plug.

2 Claims, 3 Drawing Figures

ELECTRICAL OUTLET GUARD

BACKGROUND OF THE INVENTION

Under many conditions of use, particularly in institutions such as hospitals, an electrical conductor in the vicinity of the connection to an electrical plug is often jerked laterally with such force that the plug is pulled out of the receptacle with harmful results to the plug and to the receptacle.

For example, in most hospitals, numerous electrical conductors extend from lamps, call buttons and the like, on a patient's bed to one or more plugs connected to adjcent electrical wall outlets. Frequently, when the bed must be moved, either to make up the bed or to permit cleaning the floor near and under the bed, the attendant inadvertently fails to remove the plugs from the wall sockets prior to moving the bed. If, under these circumstances, the extent of the bed's movement exceeds the free length of the conductor, the connecting plug is jerked out of the wall outlet. Often, the pull on the plug is almost at right angles to the plug alignment, i.e. substantially the entire force component exerted against the plug is parallel to the plane of the wall in which the electrical outlet is mounted. As a consequence, the outer end of the plug is pulled laterally in the direction of the conductor connection; and at the same time the prongs carried on the inner end of the plug are urged laterally in the opposite direction, the plug being pivoted about a fulcrum located where the rim of the plug is urged inwardly against the underlying receptacle.

Since most outlets and attendant cover plates are formed of nonconductive "plastic" that is fairly brittle, the wrenching forces exerted by a plug which has been violently jerked sideways often fracture the wall outlet and cover plate to such an extent as to expose the electrically conducting terminals inside the outlet. Such a condition poses an actionable risk of electrical shock to patients and staff alike.

It has been found from experience that beds or any equipment moved without careful prior detachment of the plug will destroy both plug and receptacle when the plug is jerked out two or three times at an angle of 45° or more from the vertical; and even at angles somewhat less than 45°, not only are the prongs bent but the strength of the prong grip in the receptacle is markedly diminished.

SUMMARY OF THE INVENTION

The invention relates to an attachment for an electrical plug which for all practical purposes eliminates the damage which has heretofore been incurred by a plug and wall outlet when the plug is removed forcefully from the outlet by a sharp lateral pull on the electrical conductor connected to the plug.

It is an object of the invention to provide an attractive, star-shaped attachment which is capable of being mounted on electrical plugs of all different makes and sizes and is compatible with all types of wall outlets.

It is another object of the invention to provide an electrical outlet guard which is relatively inexpensive to make and install yet is fool-proof, long-lived and most effective in preventing damage to electrical plugs and wall receptacles.

It is yet another object of the invention to provide an electrical outlet guard which, when once installed, requires no further attention, and which, if damaged for any reason, can readily be replaced with a minimum of effort and expense.

It is a further object of the invention to provide a generally improved electrical outlet guard.

Other objects, together with the foregoing, are attained in the embodiment described in the following description and illustrated in the accompanying drawings.

DESCRIPTION OF PREFERRED EMBODIMENT

Figure 2:
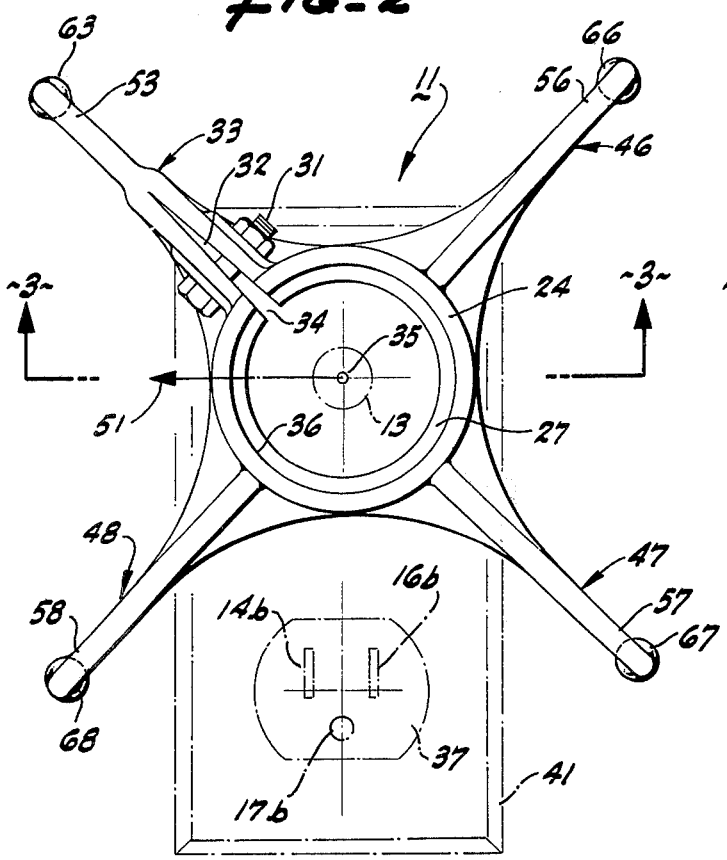
FIG. 2 is a top plan view of FIG. 1.

The electrical outlet guard of the invention is susceptible of numerous physical embodiments, shapes and sizes, depending upon the environment and requirements of use; and many of the herein shown and described embodiment have been made, tested and used under severe conditions of use. All have performed in an eminently satisfactory manner.

The electrical outlet guard of the invention, generally designated by the reference numeral 11, is used in conjunction with an electrical plug 12 connected to an electrical conductor 13 and provided with parallel prongs 14 and 16. In the interests of safety, a third, or grounded, prong 17, is often provided.

The body 18 of the electrical plug is customarily of the heavy duty type, especially when the attachment is used in an institution, such as a hospital, convalescent home, or the like, where beds as well as heavy equipment, such as portable X-ray machines and high intensity lamps are equipped with conductors extending to wall receptacles.

A widely used plug includes a sturdy, circular cylindrical external hand grip portion 21 of elastomeric material provided with an annular shoulder 22 either in abutment with or in close proximity to an outwardly facing annular rim 23 of a hollow, circular cylindrical hub 24. Disposed within the hub 24 is an internal circular cylindrical portion 26 of the plug 12, the portion 26 also being of elastomeric material.

The internal diameter of the hub 24 affords a snug fit with the interior portion 26 of the plug 12 and tight clamping engagement between plug and hub is achieved by means of a threaded fastener 31, such as a machine screw and nut, spanning a radial slot 32 in a radial limb 33 projecting outwardly from the hub 24. The radial slot 32 is in register with a slot 34 in the hub. Thus, when the fastener 31 is tightened, the walls of the slots 32 and 34 are urged together and the encompassing interior walls 36 of the hub tightly clamp the interior portion 26 of the plug 12.

Figure 1:
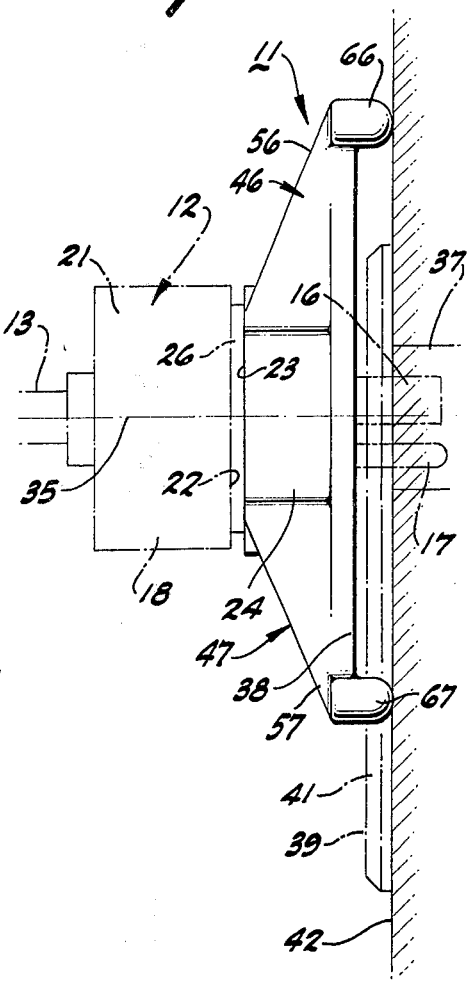
FIG. 1 is a side elevational view illustrating the guard, in full line, with an electrical plug clamped therein and with the plug prongs inserted into an electrical wall outlet, the plug, the wall and the outlet cover plate being shown in broken line.

The bottom 25 of the interior portion 26 of the plug abuts an annular flange 27 formed on the inner end of the hub 24. Thus, when the prongs 14, 16 and 17 are inserted in the respective slots in the receptacle 37 (for a front elevation, see the duplicate bottom receptacle 37 shown in broken line in FIG. 2 with corresponding slots 14*b*, 16*b* and 17*b*) they are held securely in proper alignment parallel to the hub axis 35. In actual practice, the distance between the bottom surface 38 of the hub and the outer surface 39 of the cover plate 41 is substantially zero rather than the measurable distance shown in FIG. 1. In other words, the bottom surface 38 of the hub is ordinarily in substantially face to face engagement with the underlying cover plate 41 on the wall 42.

In addition to the slotted radial limb 33 there is a plurality of other limbs 46, 47 and 48, for example. The outlet guard 11 is provided with a total of at least three limbs, spaced 120° apart; or preferably, as illustrated herein, four limbs, spaced 90° apart.

With the four-limb arrangement shown, the outer extremities 53 and 58 of the respective limbs 33 and 48 are polarly arranged so that a horizontal tug on the conductor 13 in a left-hand direction, as indicated by the arrow 51 in FIG. 2, will cause the guard 11 to tilt away from the wall about respective legs 63 and 68 as a fulcrum, the legs 63 and 68 being mounted on the ends of limbs 33 and 48.

A horizontal tug in a right-hand direction, on the other hand, will cause the guard to tilt, as on a fulcrum, about respective legs 66 and 67 located on the extremities 56 and 57 of respective limbs 46 and 47.

Upward jerks on the conductor 13 will cause tilting to occur about legs 63 and 66 whereas a downward tug will effect tilting about legs 67 and 68.

Where the lateral force components imposed by pulling on the conductor 13 are other than horizontal or vertical, tilting of the guard still occurs, but with corresponding pressures exerted by the fulcrum legs on the underlying wall surface in dependence on the angle of the force exerted by the conductor.

In the event the guard were to be formed not with radial limbs but with a central hub having a concavo-convex disc radiating outwardly therefrom to form a circular shield enveloping the entire cover plate, a force exerted in any direction by the conductor would result in tilting the disc so that a point on the periphery of the disc immediately below the force line would serve as a fulcrum against which force is exerted on the underlying wall.

In other words, under all presently contemplated constructions, the guard acts as a lever wherein the fulcrum is located below one extremity of the lever, the force is applied upwardly on the other extremity and the weight, or, rather, the resistance to dislodgement of the plug, is located at the point of force application and in an opposite sense.

By making the lever sufficiently long, the radius of curvature of the arcuate path followed by the prongs as the plug is withdrawn is such that the prongs move in a direction substantially normal to the wall even though the conductor pulls on the plug in a plane substantially parallel to the plane of the wall.

Figure 3:
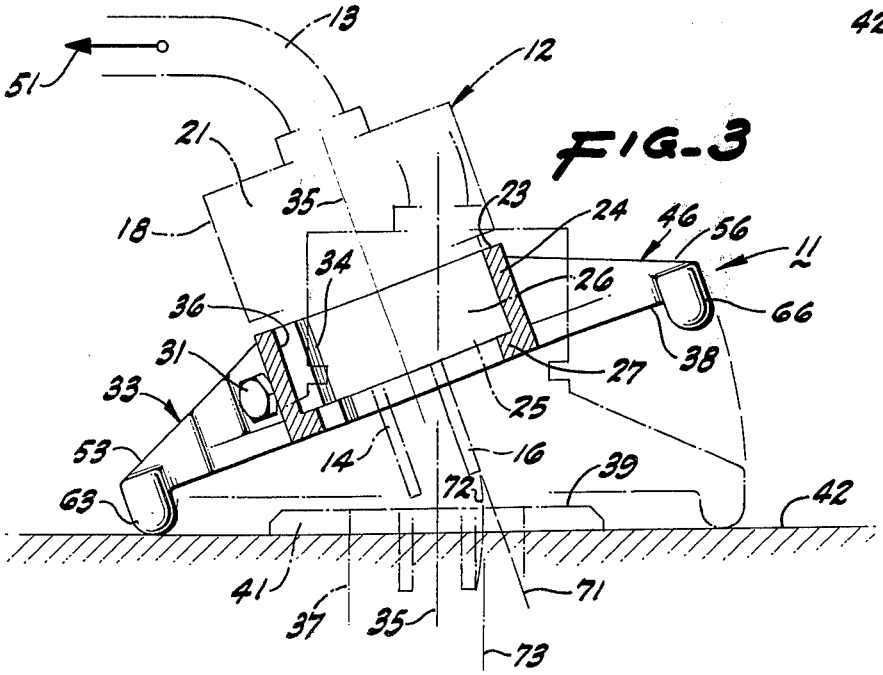
FIG. 3 is a sectional view illustrating the substantially linear withdrawal of an electrical plug from a wall receptacle despite a severe lateral force exerted on the plug by an electrical conductor connected to the plug, the plane of the section being indicated by the line 3—3 in FIG. 2, the initial position being shown in broken line and the disengaged position in full line.

To illustrate the point even more clearly, let it be assumed that the pull is in a horizontal, left-hand direction, as indicated by the arrow 51 in FIGS. 2 and 3. In this situation, the guard would tilt outwardly, away from the wall, with the legs 63 and 68 forming a fulcrum.

Were the limbs 33 and 48 to be infinitely long, the prongs 14, 16 and 17 would withdraw in a line parallel to the axis 35 of the plug, i.e. in a direction exactly normal to the plane of the wall 42.

By constructing the guard so that the limbs are of sufficient length, the tangent 71 to the arcuate path 72 of the prongs just as the prongs emerge from the receptacle (as appears most clearly in FIG. 3), is inclined but a relatively small amount with respect to a line 73 parallel to the axis 35.

In other words, the extent of the lateral force component exerted on the prongs is very small even though the conductor exerts a full lateral force on the top of the plug.

By the same token, the extent of lateral displacement of the metal contacts inside the receptacle is so small that as the prongs emerge from the receptacle, the internal prong gripping contacts resiliently return to base position. So also, the substantially linear, perpendicular path followed by the prongs when the guard pivots about the fulcrum as disclosed, in no way damages the "plastic" components of the fixture, such as the receptacle 37 and the cover plate 41.

Thus, it can be seen that in contrast to the destructive consequences which have heretofore been encountered as electrical plugs are forcefully jerked from a wall in a lateral direction, our outlet guard provides a simple, inexpensive plug attachment which is both rugged and fool-proof in operation.

What is claimed is:

1. Electrical outlet guard comprising:

a. a central hub shaped to receive an electrical plug and orient the prongs of the plug into alignment with the slots of an electrical wall outlet when said guard is located against the wall in register with the outlet, said central hub being of hollow right circular cylindrical configuration, and means on said hub for releasably clamping said guard to the electrical plug;

b. at least three circumferentially spaced limbs each mounted at one end on said hub said limbs being arrayed in radial fashion relative to the axis of said hub, at least one of said limbs being provided with a radial slot extending through the adjacent portion of said hub, said clamping means including means for urging the slot walls into closed position with the plug disposed within said hub for clamping engagement thereby as the slot is closed; and, c. a leg mounted on the other end of each of said limbs, the ends of said legs normally contacting the wall surface externally of a cover plate of the wall outlet, said legs being spaced at a distance from said hub such that the prongs of the plug remain substantially in alignment with the wall outlet slots as said guard is tilted away from the wall in any direction with at least one of said legs serving as a fulcrum as the plug is withdrawn and the tips of the prongs are moved from a first engaged position in the outlet to a second position in which the prong tips disengage the outlet.

2. Electrical guard outlet as in claim 1 in which said urging means includes a threaded fastener spanning the slot.

* * * * *